US008662928B1

(12) United States Patent
Xie et al.

(10) Patent No.: US 8,662,928 B1
(45) Date of Patent: Mar. 4, 2014

(54) RECEPTACLE CONNECTOR

(75) Inventors: Bao-Geng Xie, Guang-Dong (CN); Wei-Hong Liao, Guang-Dong (CN); Yin-Lung Wu, New Taipei (TW)

(73) Assignee: Cheng UEI Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/605,993

(22) Filed: Sep. 6, 2012

(51) Int. Cl.
*H01R 13/648* (2006.01)

(52) U.S. Cl.
USPC ..... 439/607.58; 439/607.55; 439/607.35

(58) Field of Classification Search
USPC ..... 439/607.35, 607.54–607.55, 607.58, 439/206
See application file for complete search history.

(56) References Cited

U.S. PATENT DOCUMENTS 7,695,304 B2 * 4/2010 Chiang et al. ..... 439/353
7,922,535 B1 * 4/2011 Jiang et al. ..... 439/607.35
8,083,549 B1 * 12/2011 Chiang ..... 439/607.55
8,142,225 B2 * 3/2012 Yu ..... 439/607.35
8,262,414 B1 * 9/2012 Li et al. ..... 439/607.35

* cited by examiner

*Primary Examiner* — Hien Vu
(74) *Attorney, Agent, or Firm* — Cheng-Ju Chiang

(57) ABSTRACT

A receptacle connector adapted for engaging with a plug connector includes an inner insulating housing, a plurality of terminals integrally molded to the inner insulating housing, a shielding shell, a waterproof plate and an outer insulating housing. The shielding shell is looped from a first metal plate with an inserting space being formed therein. The inner insulating housing together with the terminals is inserted into the inserting space. The shielding shell defines two buckling holes. The waterproof plate is made of a second metal plate thinner than the first metal plate in thickness, and is fastened on the shielding shell. Two opposite sides of the waterproof plate are punched upward to form two receiving hats corresponding to the two buckling holes. The outer insulating housing is integrally molded around the shielding shell, the waterproof plate and the inner insulating housing with soldering portions of the terminals projected outside.

5 Claims, 5 Drawing Sheets

RECEPTACLE CONNECTOR

BACKGROUND OF THE INVENTION

1. Field of the Invention

The present invention relates to a receptacle connector, and more particularly to a receptacle connector having a waterproof function.

2. The Related Art

Currently, a receptacle connector includes an insulating housing, a plurality of terminals and a shielding shell. The terminals are integrally molded to the insulating housing. The shielding shell encloses the insulating housing together with the terminals. The shielding shell is made of metal plate. A top of the shielding shell defines two buckling holes transversely spaced from each other. A top of a plug connector matchable with the receptacle connector defines two buckling portions which are capable of telescopically moving upward and downward. The buckling holes are used for buckling the buckling portions therein to interconnect the receptacle connector and the plug connector firmly. In order to increase a waterproof function of the receptacle connector, the two buckling holes of the shielding shell of the receptacle connector are replaced by two receiving hats punched upward from two opposite sides of the top of the shielding shell. So the receiving hats are used for receiving the buckling portions therein to interconnect the receptacle connector and the plug connector.

However, the metal plate which is used for manufacturing the shielding shell usually has a thicker thickness, so the receiving hats will have a higher height if they are punched upward directly from the two opposite sides of the top of the shielding shell. It will affect a whole height of the receptacle connector. Therefore, a receptacle connector which can lower the height of the receiving hat is urgently needed so as to lower the whole height thereof.

SUMMARY OF THE INVENTION

An object of the present invention is to provide a receptacle connector adapted for engaging with a plug connector. The receptacle connector includes an inner insulating housing, a plurality of terminals, a shielding shell, a waterproof plate and an outer insulating housing. The inner insulating housing has a base portion, and a tongue portion protruding forward from a front of the base portion. The terminals are integrally molded to the inner insulating housing. Each of the terminals has a contact portion longitudinally located in the tongue portion and exposed out of a bottom surface of the tongue portion, and a soldering portion projecting behind the base portion. The shielding shell is looped from a first metal plate with an inserting space being formed therein. The inner insulating housing together with the terminals is inserted into the inserting space of the shielding shell. A top of the shielding shell defines two buckling holes vertically penetrating therethrough. The waterproof plate is made of a second metal plate thinner than the first metal plate in thickness. The waterproof plate is fastened on the top of the shielding shell. Two opposite sides of the waterproof plate are punched upward to form two receiving hats corresponding to the two buckling holes. The outer insulating housing is integrally molded around the shielding shell, the waterproof plate and the base portion of the inner insulating housing with the soldering portions of the terminals projected outside.

As described above, the waterproof plate is fastened on the top of the shielding shell with the two receiving hats of the waterproof plate corresponding to the two buckling holes of the shielding shell for avoiding moisture accumulating in the inserting space of the shielding shell. And the second metal plate used for manufacturing the waterproof plate is thinner than the first metal plate used for manufacturing the shielding shell in thickness for lower a height of the receiving hat so as to lower a whole height of the receptacle connector. Furthermore, the outer insulating housing is integrally molded around the shielding shell, the waterproof plate and the base portion of the inner insulating housing with the soldering portions of the terminals projected outside for improving a waterproof function of the receptacle connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
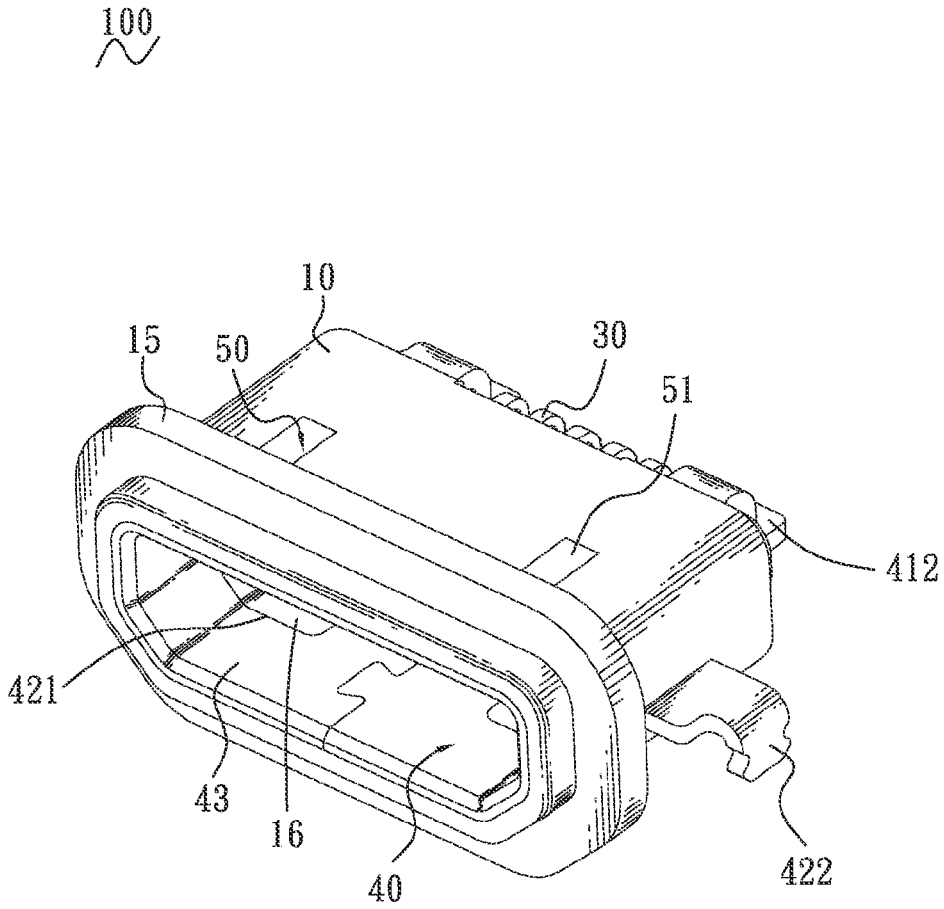
FIG. 1 is a perspective view of a receptacle connector according to the present invention.
Figure 2:
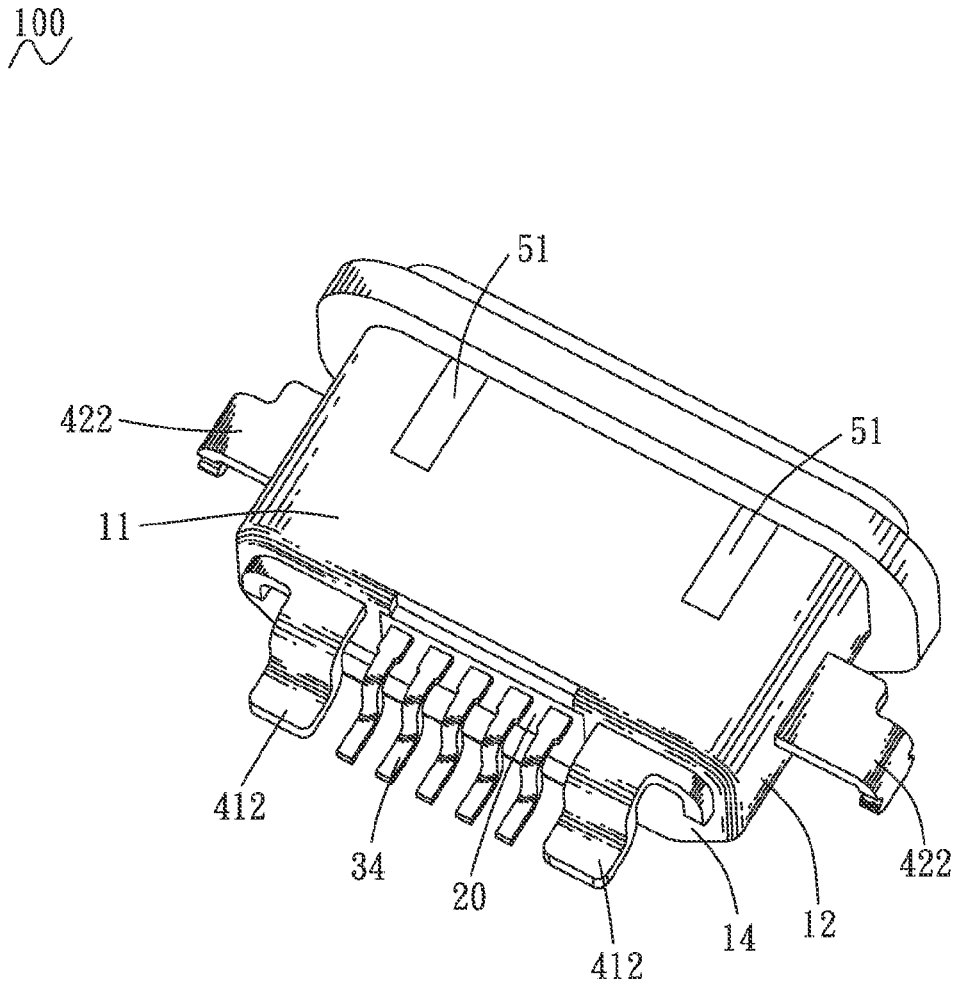
FIG. 2 is another perspective view of the receptacle connector of FIG. 1.
Figure 3:
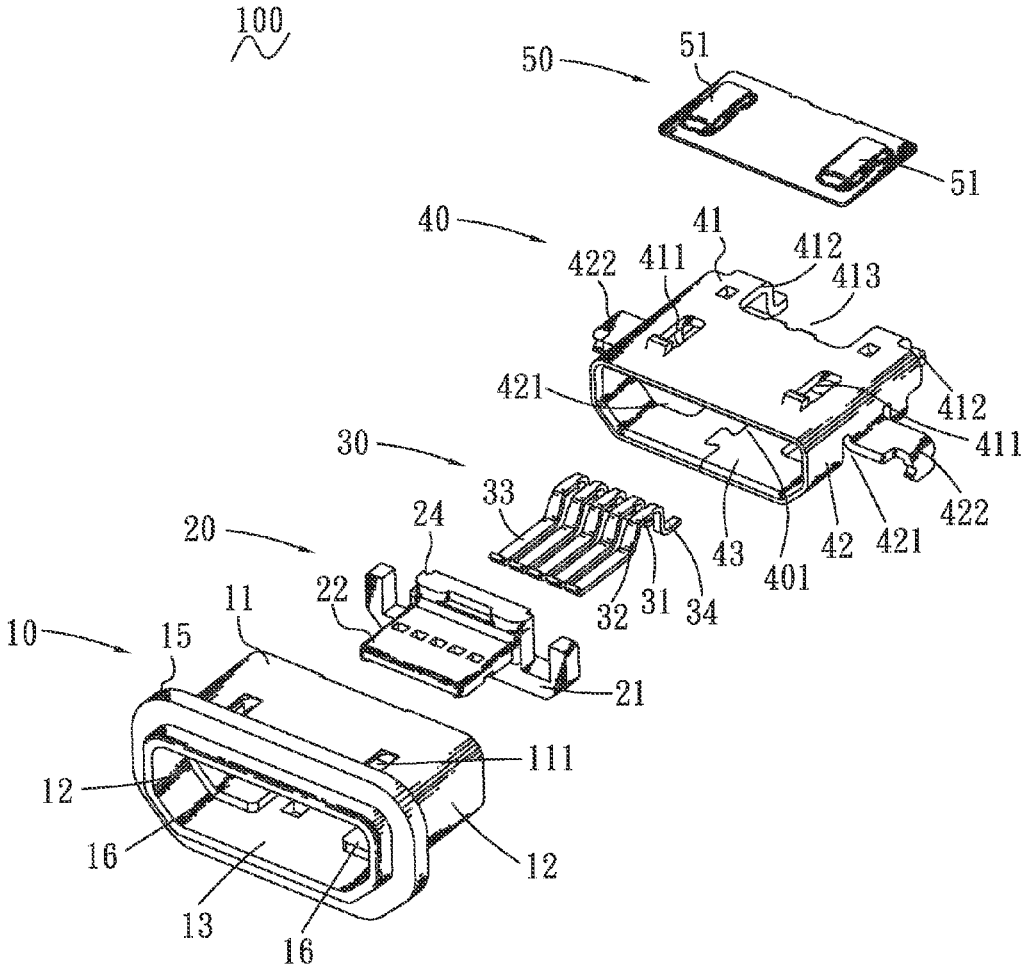
FIG. 3 is an exploded view of the receptacle connector of FIG. 1.

Referring to FIG. 1, FIG. 2 and FIG. 3, a receptacle connector 100 according to the present invention is shown. The receptacle connector 100 adapted for engaging with a plug connector (not shown) includes a plurality of terminals 30, an inner insulating housing 20, a shielding shell 40, a waterproof plate 50 and an outer insulating housing 10.

Figure 4:
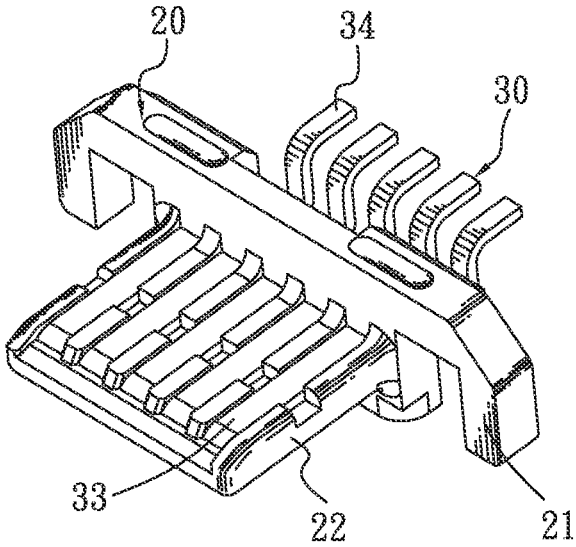
FIG. 4 is a partially perspective view of the receptacle connector of FIG. 3, wherein a plurality of terminals is molded to an inner insulating housing.

Referring to FIG. 2, FIG. 3 and FIG. 4, the terminals 30 are integrally molded to the inner insulating housing 20. Each of the terminals 30 has an elongated fastening portion 31, a connecting portion 32 slantwise extending forward and downward from a front of the fastening portion 31, a contact portion 33 extending forward from a free end of the connecting portion 32, and a soldering portion 34 protruding rearward, then bent downward and further bent rearward from a rear of the fastening portion 31. The inner insulating housing 20 has a base portion 21, and a tongue portion 22 protruding forward from a substantial middle of a front of the base portion 21. Specifically, the fastening portion 31 and the connecting portion 32 of each terminal 30 are molded in the base portion 21. The contact portion 33 of each terminal 30 is longitudinally located in the tongue portion 22 and exposed out of a bottom surface of the tongue portion 22. The soldering portion 34 of each terminal 30 projects behind the base portion 21.

Figure 5:
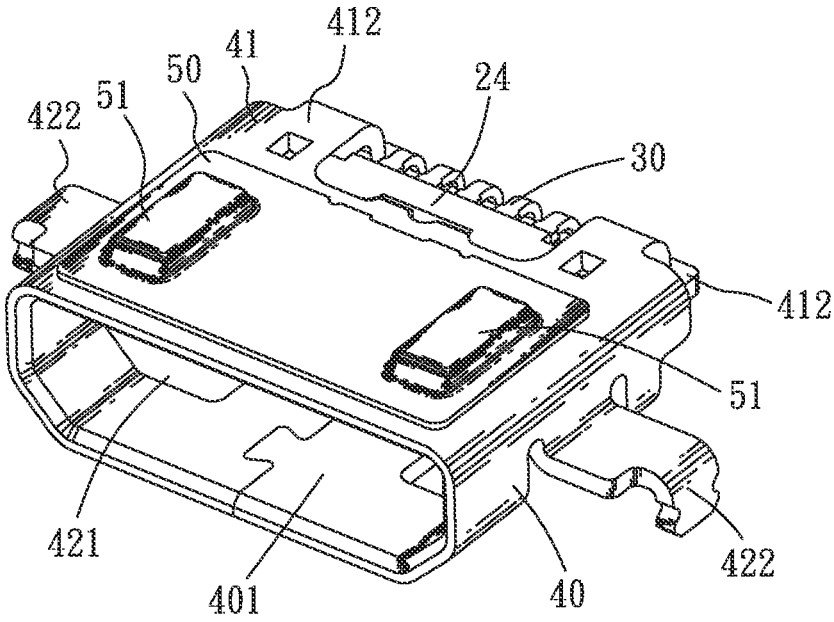
FIG. 5 is a partially perspective view of the receptacle connector of FIG. 3, wherein an outer insulating housing is removed from the receptacle connector.

Referring to FIG. 3 and FIG. 5, the shielding shell 40 is looped from a first metal plate with an inserting space 401 being formed therein. Then the inner insulating housing 20 together with the terminals 30 are inserted forward into the inserting space 401 of the shielding shell 40. A restricting portion 24 is protruded on a top of the base portion 21 of the inner insulating housing 20. The shielding shell 40 has a top plate 41, two lateral plates 42 extending downward from two opposite sides of the top plate 41, and a bottom plate 43 connecting two bottoms of the two lateral plates 42. A middle of a rear edge of the top plate 41 is recessed forward to form a restricting groove 413 for restricting the restricting portion 24 therein. A bottom of the base portion 21 of the inner insulating housing 20 is located on the bottom plate 43, two opposite side surfaces of the base portion 21 of the inner insulating housing 20 abut against two inner faces of the two lateral plates 42, and the restricting portion 24 of the inner insulating housing 20 is restricted in the restricting groove 413 of the shielding shell 40 so as to restrict the inner insulating housing 20 together with the terminals 30 to the shielding shell 40 steadily.

Referring to FIG. 3 and FIG. 5, two opposite sides of the top plate 41 of the shielding shell 40 define two buckling holes 411 vertically penetrating therethrough. The waterproof plate 50 is made of a second metal plate which is thinner than the first metal plate in thickness. The waterproof plate 50 is of a substantial rectangular shape. Two opposite sides of the waterproof plate 50 are punched upward to form two receiving hats 51. The waterproof plate 50 is fastened on the top plate 41 of the shielding shell 40 by laser welding with two spaces of the two receiving hats 51 of the waterproof plate 50 corresponding to the two buckling holes 411 of the shielding shell 40 for avoiding moisture accumulating in the inserting space 401 of the shielding shell 40.

Referring to FIG. 1, FIG. 2, FIG. 3, FIG. 4 and FIG. 5, the outer insulating housing 10 has a top wall 11, two side walls 12 extending downward from two opposite sides of the top wall 11, a bottom wall 13 connecting with two bottoms of the two side walls 12, and a rear wall 14 connecting with rears of the top wall 11, the bottom wall 13 and the two side walls 12. The outer insulating housing 10 is integrally molded around the shielding shell 40, the waterproof plate 50 and the base portion 21 of the inner insulating housing 20 with the soldering portions 34 of the terminals 30 projected outside for improving a waterproof function of the receptacle connector 100. Specifically, the top wall 11 of the outer insulating housing 10 is molded on the waterproof plate 50 and the top plate 41 of the shielding shell 40, a top of the rear wall 14 of the outer insulating housing 10 is molded on the restricting portion 24 of the inner insulating housing 20, and the rear wall 14 is molded around the base portion 21 of the inner insulating housing 20 and a rear end of the shielding shell 40. The shielding shell 40 defines two arc-shaped matching grooves 421 of which each passes through the joint of one lateral plate 42 and the bottom plate 43. The outer insulating housing 10 defines two matching portions 16 of which each protrudes across the joint of one side wall 12 and the bottom wall 13 to be received in the corresponding matching grooves 421 of the shielding shell 40. A front of an outer periphery of the outer insulating housing 10 protrudes outward to form a ring-shaped blocking rib 15 for preventing the plug connector from being overly inserted into the inserting space 401 of the shielding shell 40 of the receptacle connector 100. The top wall 11 defines two rectangular holes 111 vertically penetrating therethrough and spaced from each other for making two uppermost surfaces of the two receiving hats 51 of the waterproof plate 50 flush with a top surface of the top wall 11 of the outer insulating housing 10. Two opposite sides of a rear edge of the top plate 41 of the shielding shell 40 extend downward and then are bent rearward to form two second soldering arms 412 projecting behind the rear wall 14 of the outer insulating housing 10. Two upper inner sidewalls of the matching grooves 421 of the shielding shell 40 oppositely extend outward and then are bent downward to form a pair of first soldering arms 422 projecting outside the corresponding side walls 12 of the outer insulating housing 10.

As described above, the waterproof plate 50 is fastened on the top plate 41 of the shielding shell 40 with the two spaces of the two receiving hats 51 of the waterproof plate 50 corresponding to the two buckling holes 411 of the shielding shell 40 for avoiding the moisture accumulating in the inserting space 401 of the shielding shell 40. And the second metal plate used for manufacturing the waterproof plate 50 is thinner than the first metal plate used for manufacturing the shielding shell 40 in thickness for lower a height of the receiving hat 51 so as to lower a whole height of the receptacle connector 100. Furthermore, the outer insulating housing 10 is integrally molded around the shielding shell 40, the waterproof plate 50 and the base portion 21 of the inner insulating housing 20 with the soldering portions 34 of the terminals 30 projected outside for improving the waterproof function of the receptacle connector 100.

What is claimed is:

1. A receptacle connector adapted for engaging with a plug connector, comprising:

an inner insulating housing having a base portion, and a tongue portion protruding forward from a front of the base portion;

a plurality of terminals integrally molded to the inner insulating housing, each of the terminals having a contact portion longitudinally located in the tongue portion and exposed out of a bottom surface of the tongue portion, and a soldering portion projecting behind the base portion;

a shielding shell looped from a first metal plate with an inserting space being formed therein, the inner insulating housing together with the terminals being inserted into the inserting space of the shielding shell, a top of the shielding shell defining two buckling holes vertically penetrating therethrough;

a waterproof plate made of a second metal plate thinner than the first metal plate in thickness, the waterproof plate being fastened on the top of the shielding shell, two opposite sides of the waterproof plate being punched upward to form two receiving hats corresponding to the two buckling holes; and an outer insulating housing integrally molded around the shielding shell, the waterproof plate and the base portion of the inner insulating housing with the soldering portions of the terminals projected outside from rear portions of the outer and inner insulating housing;

wherein the outer insulating housing has a top wall, two side walls, a bottom wall and a rear wall, the rear wall is molded around the base portion of the inner insulating housing and a rear end of the shielding shell; and wherein the shielding shell has a top plate, a pair of lateral plates and a bottom plate, the shielding shell defines two arc-shaped matching grooves of which each passes through the joint of one lateral plate and the bottom plate, the outer insulating housing defines two matching portions of which each protrudes across the joint of one side wall and the bottom wall to be received in the corresponding matching groove.

2. The receptacle connector as claimed in claim 1, wherein two opposite sides of a rear edge of the top plate of the shielding shell extend downward and then are bent rearward to form two second soldering arms projecting behind the rear wall of the outer insulating housing, two upper inner sidewalls of the matching grooves of the shielding shell oppositely extend outward and then are bent downward to form a pair of first soldering arms projecting outside the corresponding side walls of the outer insulating housing.

3. The receptacle connector as claimed in claim 1, wherein the top wall defines two holes vertically penetrating therethrough and spaced from each other for making two uppermost surfaces of the two receiving hats of the waterproof plate flush with a top surface of the top wall of the outer insulating housing.

4. The receptacle connector as claimed in claim 1, wherein a restricting portion is protruded on a top of the base portion of the inner insulating housing, a rear edge of the top of the shielding shell is recessed forward to form a restricting groove for restricting the restricting portion therein, a top of the rear wall of the outer insulating housing is molded on the restricting portion.

5. The receptacle connector as claimed in claim 1, wherein a front of an outer periphery of the outer insulating housing protrudes outward to form a ring-shaped blocking rib for preventing the plug connector from being overly inserted into the inserting space of the receptacle connector.

* * * * *